United States Patent [19]

Schwierz et al.

[11] Patent Number: 4,566,783

[45] Date of Patent: Jan. 28, 1986

[54] FIXING DEVICE

[75] Inventors: Peter P. Schwierz; Adolf Rebhan, both of Wiesbaden; Roland Moraw, Wiesbaden-Naurod, all of Fed. Rep. of Germany

[73] Assignee: Hoechst Aktiengesellschaft, Frankfurt am Main, Fed. Rep. of Germany

[21] Appl. No.: 609,424

[22] Filed: May 11, 1984

[30] Foreign Application Priority Data

May 13, 1983 [DE] Fed. Rep. of Germany ..... 3317418

[51] Int. Cl.[4] ..... G03G 15/20

[52] U.S. Cl. ..... 355/14 FU; 355/3 FU; 219/216; 432/60

[58] Field of Search ..... 355/3 FU, 14 FU; 219/216, 388; 432/60; 430/99

[56] References Cited

U.S. PATENT DOCUMENTS 3,517,164 6/1970 Huggins et al. ..... 219/388
4,474,456 10/1984 Kobayashi et al. ..... 355/14 FU

FOREIGN PATENT DOCUMENTS 3220493 12/1982 Fed. Rep. of Germany .
0054965 4/1982 Japan ..... 355/14 FU
2018199 10/1979 United Kingdom .

*Primary Examiner*—R. L. Moses
*Attorney, Agent, or Firm*—Schwartz, Jeffery, Schwaab, Mack, Blumenthal & Evans

[57] ABSTRACT

The present invention relates to a fixing device comprising a curved heating plate which is heated by means of a temperature controlled electrical main heating system and an electrical stand-by heating system. The main heating system comprises two heating means mounted on the underside of the heating plate, between which is disposed a bar- or plate-shaped stand-by heating means.

11 Claims, 4 Drawing Figures

FIXING DEVICE

BACKGROUND OF THE INVENTION

The present invention relates to a device for thermally fixing a toner image developed with liquid developer for use in a copying apparatus employing a curved heating plate, along which the copying sheet carrying the toner image developed with liquid developer is guided by a guide roller arranged in the fixing station, and a device for heating the heating plate.

Thermal fixing stations are used in electrophotographic copying apparatuses in which a charge image is produced on a photoconductor layer and developed with developer liquid, to form a toner image by separated toner pigments. The toner image is transferred to a copy support, for example, paper. The copy support carrying the toner image which is still moist with developer is passed into the thermal fixing device where the toner image is to be fixed on the paper by the action of heat, so that it becomes wipe-resistant.

German Offenlegungsschrift No. 25 39 642 (equivalent to U.S. Pat. No. 4,059,394) discloses an apparatus for fixing a toner image by means of heat, in an electrophotographic copier using liquid developer. This fixing apparatus is provided with a heating installation along which the copy sheet developed with liquid developer and carrying the toner image on its upper surface is moved. The heating installation has a curved heating surface. The backside of the copy sheet is in sliding contact with the curved heating surface, in order to fix the toner image by means of heat. A partial area of the heating surface is curved. At a small distance from the heating surface, there is provided a guide roller which is brought into contact with the toner image-carrying surface of the sheet, in order to move the latter to the curved part of the heating surface and to introduce it into that part. The guide roller has a knurled circumferential surface, and its distance from the curved part of the heating surface is greater than the thickness of the copy sheet.

Liquid toners usually comprise dielectric liquids, such as Isopar G, an isoparaffinic hydrocarbon having a boiling point of about 164° C., in which charged pigments, preferably carbon black pigments, are dispersed. The liquid toners furthermore contain admixtures which control the charge of the pigments, binders, and if appropriate, fusible waxes having melting temperatures of about 80° C. When the toner image is transferred to the copy support, for example, paper or film, the support is also moistened with dispersing liquid. This transferred dispersing liquid is evaporated in the fixing device by the action of heat, and in the case of wax-containing toners, fusing of the separated-off wax particles is desirable. For this purpose, the copy support, which has been treated with toner, is moved, in known manner, (German Offenlegungsschrift No. 25 39 642) over a heating plate which normally has a temperature of between about 180° C. and 210° C. The higher temperature range is preferably chosen for wax-containing toners.

Fixing temperatures exceeding the above values are not used, because an unpredictable jamming of the copying material would result in the paper turning yellow, scaling, or, in the case of films, melting. When the copying apparatus is turned on, the known heating plate is heated during a relatively long warm-up period, and in intervals where no copies are made, the heating plate cools down again. When the copying apparatus is turned on again after a longer standstill, either the resulting copies are not properly fixed or a relatively long warming-up time which can last several minutes, must be accepted before the optimum final temperature is reached and copies fixed in a wipe-resistant manner can be obtained.

SUMMARY OF THE INVENTION

It is an object of the present invention to provide a thermal fixing device which is installed in a copying apparatus and which even after a long standstill of the copying apparatus will deliver copies developed with liquid toner that are instantly wipe-resistant.

Another object of the present invention is to provide a thermal fixing device as above which produces copies that exhibit an improved density in the full shade areas, using wax-containing toners.

It is a further object of the present invention to provide a fixing device as above which has a reduced warm-up time to reach the final operating temperature.

Still another object of the present invention is to provide a fixing device as above which can simply and inexpensively be incorporated into existing copy machines.

In accomplishing the foregoing objects, there has been provided in accordance with the present invention a device for thermally fixing a toner image developed on a copying sheet with liquid developer in a copying apparatus, comprising a curved heating plate along which the copying sheet carrying the toner image is guided by means of a guide roller, a temperature controlled, electric main heating means which is switched on when the copying process begins, and an electric standby heating means which maintains the heating plate at a constant temperature during standstill of the copying apparatus, wherein both heating means are in contact with the heating plate. The main heating means may comprise two heating bars which are substantially axially symmetrical and are embedded in the underside of the heating plate at a perpendicular to the longitudinal axis of said plate. The standby heating means may comprise a substantially axially symmetrical bar or plate, and is disposed in the region between the two main heating means such that the longitudinal axis of said means is substantially parallel with the axis of the guide roller, and the standby heating means is bisected by a vertical plane drawn through the longitudinal axis of the guide roller. The electric heating power of the standby heating means does not exceed about ten percent of the electrical power of the main heating means, and the standby means maintains the temperature of the heating plate at a temperature of about 50° C. below the optimal operating temperature of the heating plate.

Further objects, features and advantages of the present invention will become apparent from the detailed description of preferred embodiments which follows, when considered together with the attached figures of drawing.

BRIEF DESCRIPTION OF THE DRAWINGS

FIG. 4 shows a detailed block circuit diagram of the control of the standby heating system of the fixing device.

DETAILED DESCRIPTION OF PREFERRED EMBODIMENTS

The present invention provides a temperature-controlled electrical main heating means which is switched on when the copying process starts, and an electrical standby heating means which during the periods of standstill of the copying apparatus ensures a constant temperature, both heating means being in contact with the heating plate and heating the latter.

In one embodiment of the present invention, the main heating means comprises two heating bars embedded in the underside of the heating plate, between which the standby heating means adjoining the underside of the heating plate is located. The standby heating means is preferably centered with respect to the perpendicular line through the center of the guide roller.

In another embodiment of the invention, the standby heating means is embedded in the heating plate, between the heating bars.

The device of the present invention presents the additional advantage that it is suitable for supplementary installation in copiers. In the modernization of existing copiers, substantial modifications of the electric circuitry of the fixing device would be too expensive and, from a technical point of view, too complicated. Therefore, it is desirable that the measures taken to reduce the warm-up time do not intervene in the process control system of the copying apparatus, and thus, the separately switched standby heating device of the present invention avoids expensive circuit changes, in particular changes of the temperature control circuit.

Figure 1:
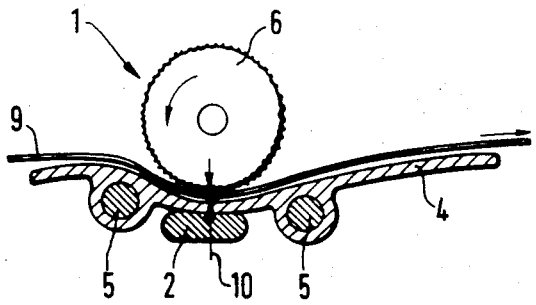
FIG. 1 shows a diagrammatical side view of a fixing device including the standby heating means of the present invention, which adjoins the underside of a heating plate of the fixing device.
Figure 2:
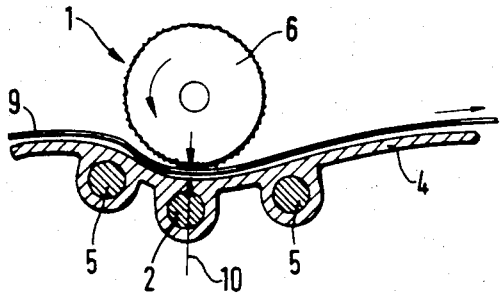
FIG. 2 shows a diagrammatical side view of another embodiment of the fixing device, where the standby heating means is embedded in the heating plate.

FIG. 1 shows an exemplary embodiment of the mechanical build-up of a fixing device 1. A heating plate 4 which is, for example, made of cast aluminum, includes, as the main heating means, two heating bars 5,5 which are embedded in the underside of the heating plate 4. Between these heating bars 5,5, the standby heating means 2 is installed which adjoins the underside of the heating plate 4. In another embodiment, shown in FIG. 2, the standby heating means is also embedded in the heating plate 4. The standby heating means 2 can be a plate- or cylinder-shaped bar or have any other suitable shape.

Heating plates of the type shown in FIG. 1 are, for example, used in Infotec copying apparatuses from KALLE Niederlassung der Hoechst AG. Similar arrangements can be realized with modified types of such heating plates.

Due to the curved shape of the heating plate 4, shown in FIG. 1, in combination with a structured, for example, knurled surface of a guide roller or pressure roller 6, an intimate contact is achieved between the heating plate 4 and the copying sheet 9 being passed through. A fixing gap 10 between the pressure roller 6 and the heating plate is about 2 mm wide, in accordance with prior art. The efficiency of the rapid heating with respect to obtaining safe, wipe-resistant fixing and good fusing of the toner images after only a short time of operation is increased by a reduction of the width of the fixing gap 10, compared to known fixing devices. Surprisingly, the width of the fixing gap 10 can be reduced down to about 0.3 mm without impairing passage of the paper or film copying sheets or smearing the toner images on the copying sheets. The width of the fixing gap 10 between the heating plate 4 including the standby heating means 2 and the main heating means 5,5, and the pressure roller 6 is from about 0.3 to 0.5 mm, preferably about 0.4 mm.

Figure 3:
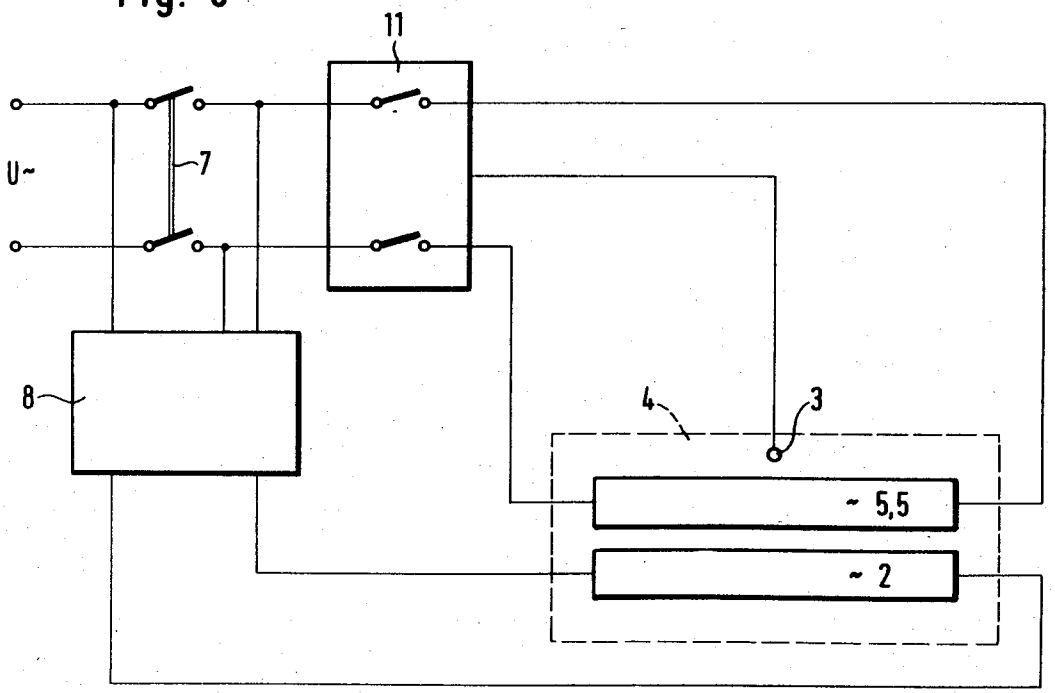
FIG. 3 shows a simplified block circuit diagram of the main heating and the standby heating systems of the fixing device.

FIG. 3 shows a block circuit diagram of the main heating and the standby heating systems. The heating plate 4 includes the main heating means 5,5 which in practice has an electric heating power of from about 700 W to 800 W. By means of this main heating system, the heating plate is heated to a temperature of about 210° C. within about 1½ to 2 minutes. The main heating system is controlled by a thermo-sensing element 3 and a control circuit 11. With this control, the temperature variations typically are within the range of about ±10° C. The standby heating means 2 adjoins the heating plate 4 or is integrated in the heating plate. Its switching is performed separately from the main heating. The standby heating means has a relatively low electric power of, for example, from about 60 W to 80 W. With the aid of this low power heating means the heating plate 4 is kept at a temperature of from about 150° C. to 160° C., independent of whether copies are being made or not. In the waiting position, the temperature of the heating plate is lower than when the main heating system is on, which maintains a temperature range of between about 180° C. and 210° C., with a variation of about ±10° C. On the other hand, this waiting position temperature is high enough to ensure that, when copies are to be made after a longer standstill, the optimum operating temperature for obtaining wipe-resistant fixing of the copies is reached within a short time after the main heating system is turned on, for example, during the pre-run time of 20 to 30 seconds required for cleaning purposes.

Therefore, the delivered copies are immediately wipe-resistant and, in the case of wax-containing toners, exhibit a high density in th full shade areas. The temperature in the waiting position should not be more than about 50° C. below the lower control temperature provided by the main heating system, so that the operating temperature is reached during the pre-run phase of the copying apparatus, i.e., within about 20 to 30 seconds.

Details of the circuitry of the standby heating means 2 are shown in FIG. 4. The main switch 7 with its two contacts SW 1-1 and SW 1-2 is located in the main voltage supply lines and can be switched to three positions, namely, a switched-off position were both contacts SW 1-1 and SW 1-2 are open, a switch position where the contact SW 1-2 is closing and the contact SW 1-1 is open, and a keying position where SW 1-2 is closed and SW 1-1 is closing. These three switch positions are summarized in the table below:

| | SWITCH POSITION | | |
|---|---|---|---|
| Contacts | Off | On | Keving |
| SW 1-1 | open | open | closing |
| SW 1-2 | open | closing | closed |

From one of the main lines, in which a mains fuse is provided, lines rt and ws lead to an operating contact 33/34 and to a rest contact 41/42 in the relay circuit 8 which includes a bipolar relay 13/14 and 23/24 with a low-voltage contactor SKS. Via a wiring point b1, the contactor SKS is connected to the non-fused main line, and via the connection b it is connected to the contact points 34, 42.

The connection point a of the contactor SKS is connected to the contact point 23.

The fused main line is directly connected to the contact 13/14. Via the contact points 14, 24 a glow lamp indicating the operation of the standby heating means 2 is actuated. The rest contact 41/42 of the relay circuit 8 remains closed until the contactor SKS pulls up, then it opens while the operating contact 33/34 is simultaneously closing.

Via the relay circuit 8 and the main switch 7, the main voltage is supplied to the standby heating means 2. Details, such as thermo-fuses and circuit modifications required for a voltage change from 120 V to 220 V, have been omitted for reasons of clarity.

Upon actuation of the switch 7, first the contact SW 1-2 closes. It remains closed until the switch is turned off again. Then, by keying of the switch 7, the contact SW 1-1 closes momentarily, and voltage is applied to the low-voltage contactor SKS via the fuse, SW 1-1, the contact 41/42, b, SKS, a, and SW 1-2. The contactor SKS actuates its contacts, holds itself via the contact 33/34 and turns on the standby heating and the glow lamp via the contacts 23/24 and 13/14.

Since the standby heating means 2 is to be operated with half the power only, it is connected to the voltage line via the diode (1N 4007), which functions as a half wave rectifier.

What is claimed is:

1. A device for thermally fixing a toner image developed on a copying sheet with liquid developer in a copying apparatus, comprising:

a curved heating plate;

a guide roller disposed such that it guides the copy sheet carrying the toner image along the surface of said heating plate;

a temperature controlled, electric main heating means which is switched on when the copying process begins;

an electric standby heating means which maintains the heating plate at a constant temperature during standstill of the copying apparatus, wherein both of said means are in contact with the heating plate; and a control circuit;

wherein the standby heating means is connected to the supply voltage by a relay circuit and said relay circuit can be actuated by means of a main switch of the copying apparatus; and wherein the relay circuit includes a biopolar relay for connecting the standby heating means to the supply voltage and the bipolar relay includes a low-voltage contactor with a self-holding contact as an operating contact and with a rest contact which remains closed until opened by the actuated low voltage contactor.

2. A fixing device according to claim 1, wherein the main heating means comprises two heating bars which are embedded in the underside of the heating plate and between which the standby heating means is disposed on the underside of the heating plate.

3. A fixing device according to claim 2, wherein the standby heating means is bisected by a vertical plane which includes the longtudinal axis of the guide roller, and the longitudinal axes of said standby heating means and guide roller are substantially parallel.

4. A fixing device according to claim 2, wherein the standby heating means is embedded in the heating plate between the heating bars.

5. A fixing device according to claim 1, wherein the electric heating power of the standby heating means does not exceed about 10% of the electric heating power of the main heating means.

6. A fixing device according to claim 1, wherein the standby heating means maintains the temperature of the heating plate during the standstill periods of the copying apparatus, up to about 50° C. below the optimal operating temperature and is not allowed to exceed the lowest temperature of the control range of the main heating means.

7. A fixing device according to claim 1, wherein a fixing gap between the curved heating plate and the guide roller is from about 0.3 mm to 0.5 mm wide.

8. A fixing device as in claim 2, wherein the main heating bars are substantially axially symmetrical and are disposed at a perpendicular to the longitudinal axis of the heating plate.

9. A fixing device as in claim 1, wherein the standby heating means control circuit is provided with a half wave rectifier.

10. A fixing device as in claim 1, wherein the main heating means comprises an electric heating power of from about 700 Watts to 800 Watts.

11. A fixing device as in claim 1, wherein the main heating means maintains the heating plate at a temperature within the range of from about 180° C. and 210° C. while copies are being made.

* * * * *